United States Patent [19]

Marushkin et al.

[11] 4,116,270

[45] Sep. 26, 1978

[54] TUBULAR COILED HEAT EXCHANGER AND DEVICE FOR MANUFACTURING SAME

[76] Inventors: Ruf Fedorovich Marushkin, ulitsa Miklukho-Maklaya 33, kv. 33; Jury Ivanovich Zelenov, 10 Parkovaya ulitsa, 4, kv. 14; Nikolai Alexandrovich Kozlov, ulitsa Usacheva, 29, kv. 521; Nikolai Prokopievich Filin, Trekhgorny val, 24, kv. 54; Iosif Isaakovich Gurevich, Strastnoi bulvar, 13a, kv. 66; Vladimir Vasilievich Usanov, Novodevichy proezd, 2, kv. 5; Oxana Kirillovna Krasnikova, ulitsa Udaltsova, 4, kv. 127; Vladimir Nikolaevich Lyalin, ulitsa Mikhailova, 29, korpus 3, kv. 103; Viktor Ivanovich Bykasov, Ryazansky prospekt, 53, kv. 41; Felix Petrovich Kirpichnikov, ulitsa Marii Ulyanovoi, 6, kv. 40; Viktor Petrovich Belyakov, Leninsky prospekt, 90, kv. 60; Vladimir Grigorievich Pronko, B. Kozlovsky pereulok,11, kv. 42; Vera Ivanovna Epifanova, Frunzenskaya naberezhnaya, 36, kv. 251; Vasily Dmitrievich Nikitkin, Tsvetnol, bulvar, 25, kv. 95; Zakhar Ivanovich Kandaurov, Frunzenskaya naberezhnaya, 16, kv. 52; Tamara Sergeevna Mischenko, prospekt Mira, 85, kv. 110; Alexandr Alexeevich Lavrentiev, Frunzensky val, 2, kv. 154; Galina Alexeevna Kondratieva, Volgogradsky prospekt, 130, kv. 27, all of Moscow; Alexandr Mikhailovich Orekhov, ulitsa Lesnaya, 2, Moskovskaya oblast, Schelkovsky raion, poselok Sverdlovsky; Evgeny Valentinovich Onosovsky, ulitsa Z.i A. Kosmodemyanskikh, 8/7, kv. 131, Moscow; Elvin Konstantinovich Kalinin, Schelkovsky proezd, 11, korpus 1, kv. 73, Moscow; Genrikh Alexandrovich Dreitser, ulitsa Shvernika, 6, korpus 2, kv. 35, Moscow; Dmitry Arkadievich Kirikov, Izmailovsky bulvar, 12, kv. 24, Moscow; Boris Alexandrovich Chernyshev, Seleznevskaya ulitsa, 40, kv. 10, Moscow, all of U.S.S.R.

[21] Appl. No.: 660,268

[22] Filed: Feb. 23, 1976

[30] Foreign Application Priority Data

Jul. 30, 1975 [SU] U.S.S.R. ..... 2153901

[51] Int. Cl.[2] ..... F28D 7/02; F28F 1/36; F28F 1/22

[52] U.S. Cl. ..... 165/162; 165/163; 165/172; 165/179; 165/184

[58] Field of Search ..... 165/180, 163, 179, 162, 165/172, 184

[56] References Cited

U.S. PATENT DOCUMENTS

| | | | |
|---|---|---|---|
| 1,777,356 | 10/1930 | Fisher | 165/163 X |
| 1,785,159 | 12/1930 | Ullman | 165/163 |
| 2,644,675 | 7/1953 | Kopp | 165/163 X |
| 3,138,201 | 6/1964 | Huet | 165/163 |
| 3,202,210 | 8/1965 | Hughes | 165/179 |
| 3,217,799 | 11/1965 | Rodgers | 165/179 |
| 3,332,478 | 7/1967 | Saunders | 165/163 X |
| 3,455,379 | 7/1969 | Habdas | 165/184 |
| 3,524,734 | 8/1970 | Kamiryo | 165/163 X |
| 3,643,735 | 2/1972 | Huggins | 165/184 X |
| 3,826,304 | 7/1974 | Withers, Jr. et al. | 165/179 |

FOREIGN PATENT DOCUMENTS

| | | | |
|---|---|---|---|
| 846 of | 1882 | United Kingdom | 165/184 |

*Primary Examiner*—Charles J. Myhre
*Assistant Examiner*—Sheldon Richter
*Attorney, Agent, or Firm*—Lackenbach, Lilling & Siegel

[57] ABSTRACT

A tubular coiled heat exchanger adapted for cooling or heating of various fluids in various fields of industry. The heat exchanger comprises a shell and a core around which tubes having essentially the same length are wound at least in two layers. The tubes may have grooves projecting into the tubes to intensify heat abstraction within the tubes. A member of a streamlined cross-section, such as, a wire, adapted for forming fins is wound around the tubes with a pitch of at least twice the diameter of the wire. The tubes are wound around the core so that the tops of the fins of each tube coil come alternately in contact with those of the fins and with tube surfaces of adjacent coils. The above embodiment of the heat exchanger makes it possible to vary the number of turns of the tubes when winding the tubes being set once without any distance pieces between the layers. This ensures the manufacture of a highly compact heat exchanger featuring high thermal and hydrodynamic properties. The heat exchanger may prove to be most advantageous in cryogenics, in plants for liquefaction and separation of natural gas in particular.

3 Claims, 13 Drawing Figures

TUBULAR COILED HEAT EXCHANGER AND DEVICE FOR MANUFACTURING SAME

The present invention relates to heat exchange apparatus and to equipment for manufacturing same and more particularly to coiled tubular heat exchangers and to devices for the manufacture of said heat exchangers.

The coiled tubular heat exchanger, according to the invention, may proved to be most advantageous in cryogenics, especially in plants for liquefaction and separation of natural gas.

The present invention can also find application in any field of engineering, where there is a need for highly compact and reliable in service tubular heat exchangers.

The invention is particularly useful for low-temperature refrigerating systems, especially in helium refrigerators and liquefiers.

The heat exchangers of the helium refrigerators must meet a number of requirements stemming from the following specific features inherent in their operating conditions.

In the heat exchangers of said helium refrigerators cold is regenerated over a broad range of temperatures (from 3.5 K to 330 K). Therefore said heat exchangers are characterized by a high temperature gradient and considerable thermal loads accordingly, this necessitates great heat exchange surface areas. At the same time the energy available for pumping helium through the apparatus is very small owing to limited permissible pressure losses in hot direct helium flow lines (usually its pressure amounts to 8–25 atm) and especially in a cold helium return line running in the inter-tubular space (its pressure varying from 0.5 - to 1.5 atm). Thus, in refrigerators producing cold down to 4.5 K the permissible pressure losses in the helium return line, including all heat exchange apparatus, all lines, headers and sleeves, should not exceed 3000 mm $H_2O$.

In case of the coiled tubular heat exchangers these two conditions require, as a rule, the creation of multilayer apparatus in which tubes are wound around a core in several layers.

To obtain adequate refrigerator performance characteristics in terms of their energy requirements, heat exchangers with low temperature differences must be used. It is especially important in the heat exchangers operating at temperatures below 20 K. In this case the temperature difference between heat exchange flows must not be in excess of one degree. A temperature difference within a 0.1°–0.5° range is highly efficient.

The creation of efficient, i.e., meeting sufficiently fully the afore-mentioned conditions, heat exchangers presents a complicated engineering problem. It is especially difficult to provide a small temperature difference in view of the so-called secondary effects. Said secondary effects include in the first place the thermal conductivity lengthwise of the structural elements and nonuniform distribution of a gas flow among individual heat exchanger channels.

In view of the above-outlined conditions of operation the heat exchangers of the helium refrigirators must meet the following requirements:

have a compact heat exchange surface so that heat exchangers of reasonable size could have sufficiently developed heat exchange surface areas;

feature high thermal performance characteristics at comparatively low pressure losses;

be characterized by small secondary effects ensuring small temperature differences between the heat exchange flows;

be technologically simple and economically profitable in terms of their manufacture;

feature a high degree of functional reliability.

Known in the art is a coiled tubular heat exchanger utilized in helium refrigerators and liquefiers manufactured by the US, British and French firms.

Said apparatus which is known to those skilled in cryogenics under the name of a heat exchanger of the Colline construction type, comprises a cylindrical core around which tubes are wound, said tubes having helical fins made in thin strip. Use is also made of resilient packing cords arranged in recesses between the tube coils on their external and internal sides. Said heat exchanger has an external shell and spacer shells disposed between tube layers. The tubes of each layer are wound so that the distance between the centres of the cross-sections of said tubes in adjacent coils is equal to a sum of the tube diameter plus twice the height of a fin.

As a result, the tube coils in each layer come in contact only with the tops of the fins, while those arranged between the tube layers do not contact, the layers being separated by the spacer shells.

In said heat exchangers the fins are fastened to the tubes by soldering.

The above-outlined heat exchanger ranks among highly efficient apparatus because it has adequate thermal performance characteristics, the pressure losses in the intertubular space of said apparatus being relatively small.

A disadvantage of this heat exchanger resides in its highly sophisticated design. In said heat exchanger arranged between the tube layers are spacer shells which keep the distance between the tube layers constant, preclude fin distortion and their ingress into the neighboring layers. At the same time the spacer shells provide a possibility of heat transfer along said shells bypassing the heat exchange surface. This may result in a higher temperature difference between heat exchange flows. Moreover, the inherent design of said heat exchangers contemplates the winding of the tubes with the resilient cords. The latter contribute to making the finned surface more streamlined and fill possible clearances or leaks between the tube layers and shells. However, owing to the use of said cords and spacer shells, as well as owing to a need for soldering the fins the manufacture of the heat exchangers of the described type is rather complicated and labour-consuming. This is particularly true for low-diameter tubes making up highly compact heat exchange surfaces, and for large-size multilayer apparatus intended for liquefiers and refrigerators having high cooling capacities.

In view of said design peculiarities mechanization of one the basic production processes — the winding of finned tubes around a cylindrical core — can be practically carried out only with great difficulties.

Also known in the art is a coiled tubular heat exchanger, comprising a shell and a cylindrical core, said core having tubes wound around it in several layers, these tubes having a wire of a round cross-section wound helically thereabout. The tubes of each layer are wound with a certain clearance between the adjacent coils so that the distance between the centers of the cross-sections of said tubes in neighboring coils in each layer exceeds the value that is equal to a sum of twice the diameter of the tube plus twice the diameter of the wire, while the distance between the centers of the tubes in the coils of the adjacent layers is equal to a sum of twice the diameter of the tube plus twice the diameter of the wire. As a result, the tube coils in each layer do not come in contact with each other and those between the adjacent layers contact with the tops of their fins.

Such a coiled heat exchanger having tubes finned with wire is simple both in terms of its design and manufacture. A disadvantage of said heat exchanger lies in a constant number of turns of the tubes in the layers. Said heat exchangers can be employed only with a small number of tube layers varying from one to three. As the number of said layers increases, the diameter of each tube layer grows considerably as compared with that of the core.

With a constant number of turns the tubes in the layers differ considerably in their length. This causes a nonuniform distribution of a fluid, such as, helium among the tubes, which precludes the possibility of obtaining a small temperature difference in said heat exchanger and in case of a multilayer heat exchanger results in the apparatus becoming inoperable.

As far as the known designs of the coiled tubular heat exchangers of the described type are concerned, known in the art are devices for manufacturing same.

Widely known are various devices for making fins on a tube. Thus, known in the prior art is a device for manufacturing tubes having fins made from a strip of rectangular cross-section. Said device comprises a bed, a drive with a transmission, an axial tube feed gear, a reel with the strip, said reel being fitted with a spring ensuring the tensioning of the strip, and a gear adapted to form shaped grooves on the strip stock (see, e.g., U.S. Pat. No. 2,865,424, Cl. 153-645).

In practice, finned tubes are wound around a cylindrical core manually.

Also known in the art are various devices for winding plain tubes around a cylindrical core, particularly a device for helical winding of the tubes around the core, said device comprising a gear for imparting the tube a certain radius of curvature prior to winding it around the core.

This precludes the formation of sharp-edged tube coils which may take place as the tubes are being wound around distance pieces arranged on the tube layers and spaced from each other. Those skilled in the art and working in this field of engineering know that the term "sharp-edged" denotes the configuration of the tube coils shaped as a polyhedron with the tops at the points of location of the distance pieces. Tube tension in said device is effected by means of a steel rope, one end of said rope being coupled with a gear imparting a curvature to the tube and the other one with a carriage travelling along rails running parallel to the core axis.

The main object of the present invention is to provide a coiled tubular heat exchanger with such a winding of an element making fins and with such a winding of finned tubes around a core, which along with high thermal and hydrodynamic properties of the heat exchanger would ensure a sufficiently simple, reliable and compact structure, and also a provision of devices for its manufacturing enabling mechanization of separate manufacturing steps: winding of the member making fins, forming of grooves on the tubes and winding of the finned tubes around the core.

Said object is achieved in a tubular coiled heat exchanger, comprising a shell and a core arranged inside it and coaxially the therewith, said core having tubes wound around at least in two layers, these tubes having a member wound thereabout and making fins, said tubes being essentially of the same length to pass a fluid therealong and therebetween in a space defined by said shell and said core, wherein said member for making the afore-mentioned fins is, according to the invention, wound around each tube with a pitch equal to at least twice the thickness of said member and the tubes in each of the above layers are wound around the core so that the distances between the centers of the tube cross-sections in subsequent coils of one layer and between said centers and those of the cross-sections of the tubes in the coils of an adjacent layer gradually vary from the value equal to a sum of the diameter of said tube plus twice the height of the fin to the value equal to a sum of the tube diameter plus one height of the fin, the above distance relationship periodically repeating over the entire length and cross-section of the heat exchanger, whereby the tops of the fins of each tube coil come alternately in contact with the tops of the fins and tube surfaces of the adjacent coils.

With the above embodiment the number of turns in the layers of a multilayer coiled tubular heat exchanger can be varied without using any additional structural distance pieces. This enables a continuous winding of the tubes around the cylindrical core with said core being set once.

It is expedient that each tube have on its external surface annular grooves running along its entire length and projecting into the tube.

This enables a more intense heat transfer within the tubes which enhances the total heat transfer coefficient of the coiled tubular heat exchanger.

It is also sound practice that the member making fins on a tube have a streamlined cross-section.

With the above embodiment of the fin-making member said fins may act concurrently as distance pieces between the layers of the tubes and the coils thereof, this allowing a close continuous winding of the tubes under tension around the core, which enables mechanization of the winding of the finned tubes.

With the close winding of the tubes having fins of the above configuration, streamlined small-size channels are formed between the tube layers which enables highly-compact tubular heat exchange surfaces to be obtained.

Moreover, the fin-making member having the above embodiment can be wound around the tube with a tension ensuring an intimate contact between the fin and the tube, which allows obviating both the soldering or welding operations during finning.

Owing to a simpler design and technology, as compared with the prior-art constructions of the heat exchangers of the type described, the tubular coiled heat exchanger, according to the invention, constitutes a more compact and reliable structure; it also has high thermal properties and relatively low pressure losses. Mechanization of the basic process involved in the manufacture of said heat exchangers does not present a serious problem.

It is good practice, if the device for making fins on a tube for the tubular coiled heat exchanger, according to the invention, would have a hollow shaft drive with a sleeve arranged inside it, coaxially therewith and rigidly connected thereto to pass the tube made composite with a longitudinal junction plane and having a thread on its internal surface to enable positive arrangement of the fin-making member and axial feed of said tube with the shaft in rotation.

With the above embodiment two operations, i.e., the winding of the fin-making member around the tube having a considerable length and axial feed of said tube, can be effected simultaneously. In this case the forces arising during the winding of the fin-making member around the tube ensure a tight contact of said member and the tube. Upon winding the fin-making member, no soldering or welding is required to secure said member to the tube.

Moreover, with the above device fins of various size and in various materials can be wound around the tubes also of various diameters and in various materials by making use of one machine and a set of easily mountable and removable sleeves.

It is good practice that in the device for winding finned tubes around a core of a coiled tubular heat exchanger with a feed reel adapted for supplying the finned tubes to the rotating core mounted on a rotatable support about its axis and movably under the effect of a force developed on the core along the core axis, in the course of winding of said tubes, according to the invention, said feed reel would have two sleeves fixed rigidly on said support and mounted in rotating reel hubs coaxially therewith, said sleeves accommodating a shaft arranged inside freely and rotably about it axis and mounting a disc that is rigidly fixed thereon, said disc being connected with its periphery to the reel and tightly urged with its end faces to those of the sleeves when the tubes are unwound from said reel to preclude their pay-off.

With the above embodiment a tube tension device can be snugly arranged within the feed reel of the device to provide tube tensioning. Moreover, the reels of the above design are suitable for the tubes in a broad range of diameters. The proposed device may be particularly useful for winding finned tubes of various sizes and in various metals.

It is advisable that in the device for winding finned tubes around a core, according to the invention, a spring be wound around each reel hub, one end of said spring being rigidly fixed on the disc periphery and the other one being secured, also rigidly, on the reel, this resulting in winding up of the spring during core rotation and in its unwinding when it stops, said unwinding imparting a reverse rotation to the reel to enable tube tensioning.

Said embodiment allows combining the tube tension device and that for imparting a reverse rotation to the reel when the core stops in one compact structure.

It is also expedient that the device for forming grooves on the external surface of a stock for the coiled tubular heat exchanger, comprising a pair of rollers arranged one above the other rotatably about their pivots, said rollers having teeth for forming said grooves on the stock positively fed there between, according to the invention, have a drive shaft with an axial space adapted to accommodate the stock which is a tube, and the roller pivots be mounted on said shaft to rotate together with said shaft around the tube so that the rollers would have a possibility of moving crosswise of the geometric axis of the shaft, the distance between the roller pivots remaining constant during said motion, the tops of one pair of the teeth provided on the roller, forming one groove, facing each other in the course of forming of each groove.

With said device it is possible to form grooves on thin-walled tubes of small diameters and considerable lengths. Moreover, said device can be easily combined with the fin-making device, this ensuring a continuous process of producing finned tubes having a considerable length and fitted with grooves.

The devices, according to the present invention, enable mechanization of the most labor-consuming operations involved in the fabrication of coiled tubular heat exchangers, such as, forming grooves on a tube, making fins and winding of finned tubes around a cylindrical core.

Various other features and advantages of the present invention will hereinafter become more fully apparent from the following description of an exemplary embodiment to be had in conjunction with the accompanying drawings, in which.

Figure 6:
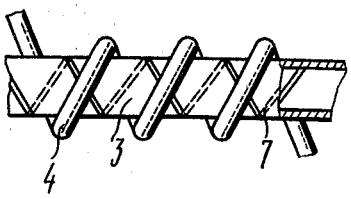
Figure 7:
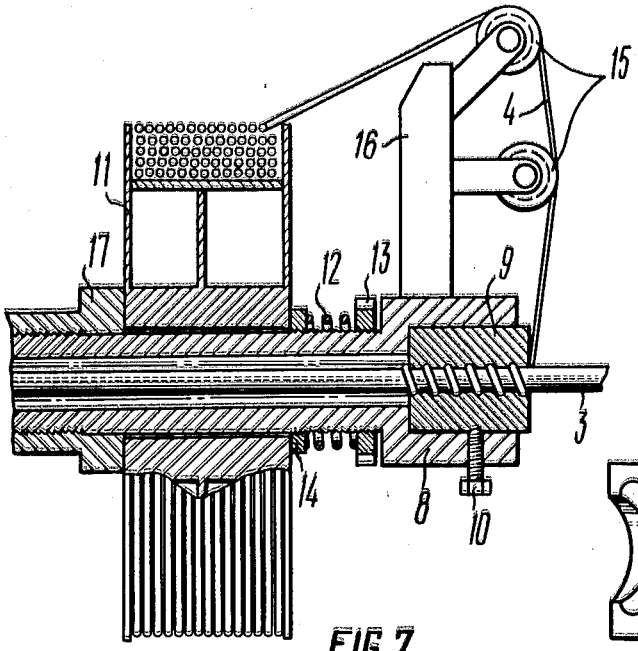
Figure 8:
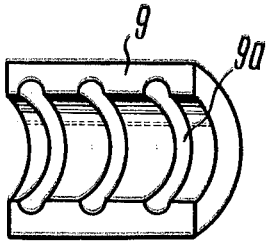
Figure 9:
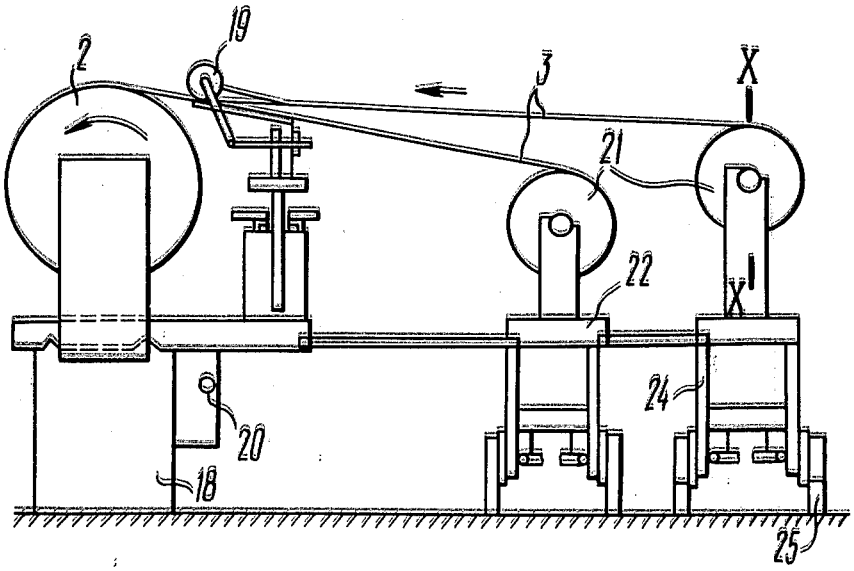
Figure 10:
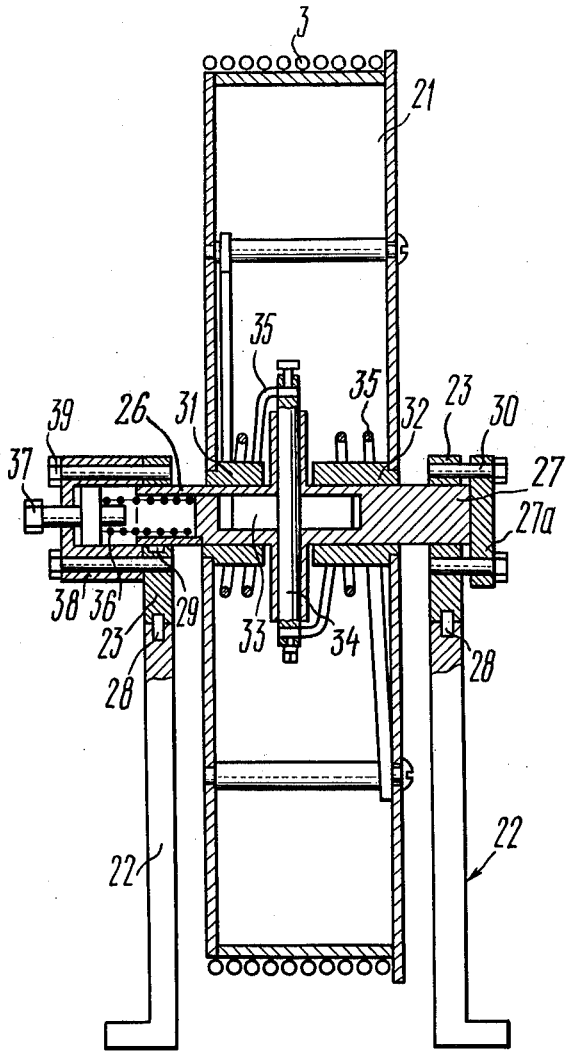

FIG. 6 — shows a heat exchanger with helical grooves whose location does not coincide with that of the wire;

FIG. 7 shows diagrammatically a device for making fins on a tube of a tubular coiled heat exchanger, according to the invention;

FIG. 8 shows diagrammatically one half of a sleeve of the device for making fins;

FIG. 9 shows diagrammatically a device for winding finned tubes around a core of a coiled tubular heat exchanger, according to the invention;

FIG. 10 is a scaled-up section X—X of FIG. 9.

Figure 12:
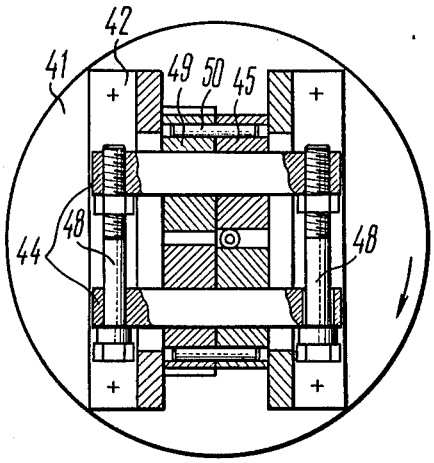
Figure 11:
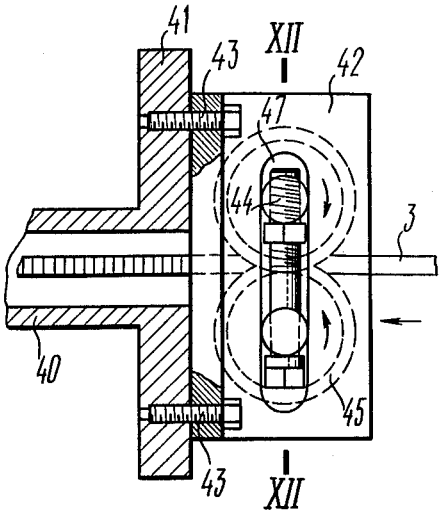
Figure 13:
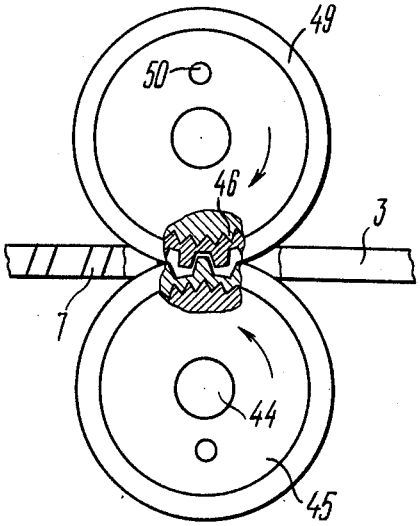

FIG. 11 shows diagrammatically a device for forming grooves on the external surface of a stock for a coiled tubular heat exchanger, according to the invention;

FIG. 12 — scaled-up section XII—XII of FIG. 11;

FIG. 13 is a schematic drawing showing rollers with teeth and pinions holding said rollers in place in the device for forming grooves.

Figure 1:
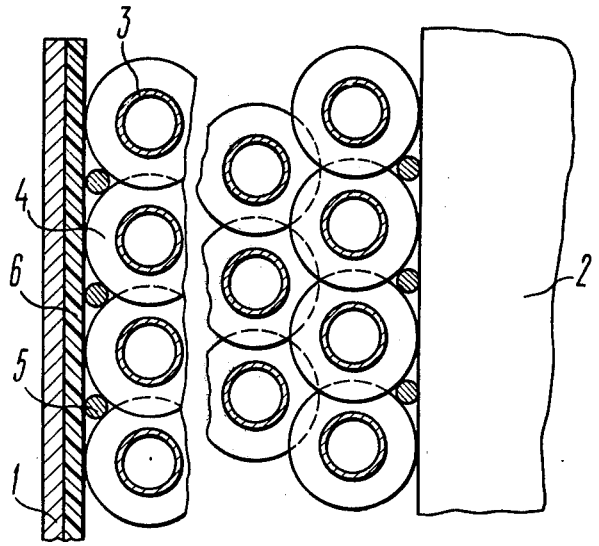
FIG. 1 is a fragmentary longitudinal schematic sectional view of a tubular coiled heat exchanger, according to the invention.
Figure 3:
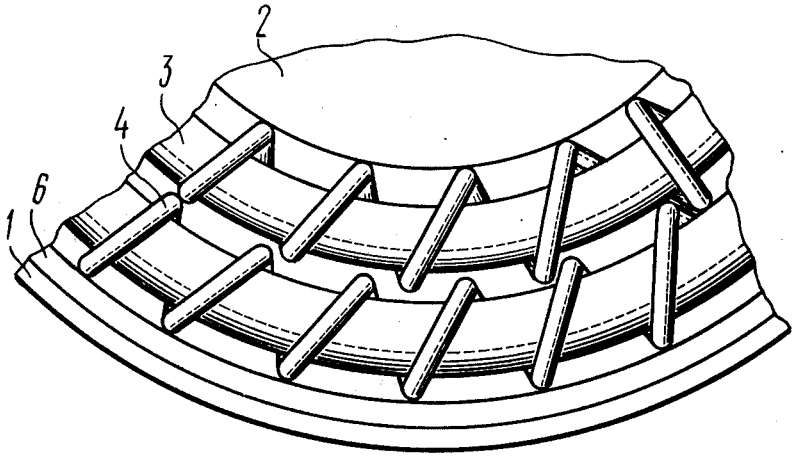
FIG. 3 shows diagrammatically a tubular coiled heat exchanger, according to the invention (conventionally a double-layer heat exchanger is represented), a fragmentary plan view.
Figure 2:
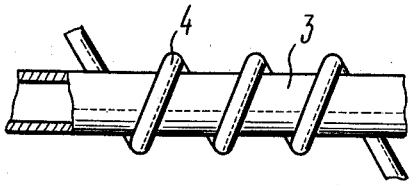
FIG. 2 is a fragmentary longitudinal sectional view of a heat exchanger tube having a fin-making member wound thereabout, said member being made in the above-outlined embodiment from a wire of a round cross-section.

A heat exchanger, according to the present invention, may prove to be most advantageous in helium refrigerators and liquefiers in a low, medium and high-capacity range. The proposed tubular coiled heat exchanger comprises a shell 1 (FIGS. 1, 3) having a cylindrical outline. Said shell accommodates a cylindrical core 2 mounted coaxially therewith. Wound around said core 2 at least in two layers are tubes 3 (FIGS. 1 through 6, 7, 9, through 11, 13), said tubes being essentially of the same length and having a member 4 (FIGS. 1 through 7) wound thereabout and forming fins, said tubes being adapted to pass a fluid therealong, in this case a hot direct flow of gaseous helium. The tubes are wound around the core 2 with a resilient cord 5 (FIG. 1) which is adapted to fill possible clearances (leaks) between the core 2 and the first layer of the tubes 3. With the aid of said cord a channel is formed resembling in its outline those formed between the layers of the tubes 3. Therefore the heat transfer conditions created in said channels formed between the core 2 and the first layer of the tubes 3 approximate those in the channels formed between the tube layers. Various projections or recesses on the core having a round, oval, triangular or some other cross-section, can act as the cord 5. The external layer of the tubes 3 is also provided with the resilient cord 5 wound thereabout, said cord 5 together with a film 6 (FIG. 3) remedying a certain irregularity of the last layer of the tubes 3 rendering them cylindrical and eliminating possible leakages between the last layer of the tubes 3 and the external shell 1.

In a space defined by the shell 1 and the core 2 between the tubes 3 passes a fluid, in this particular case a colder return gaseous helium flow. The member 4 (FIGS. 1 through 7) wound around the tubes 3 and making the fins in this embodiment is a wire. The latter (wire) is wound with a pitch equal to at least twice the diameter of said wire. In the proposed heat exchanger the tubes 3 are wound so that the distance between the centers of the cross-sections of the tubes 3 in subsequent coils of one layer and between said centers and those of the cross-sections of the tubes 3 in the coils of an adjacent layer vary gradually from the value equal to a sum of the diameter of the tube 3 plus twice the height of the fin to the value equal to a sum of the diameter of the tube 3 plus one height of the fin, the above distance relationship repeating perodically over the entire length and cross-section of the heat exchanger. As a result, the tops of the fins of each coil of the tube 3 come alternately in contact with the fin tops and with the surfaces of the tubes 3 in the adjacent coils. The above winding of the tubes 3 makes it possible to change the number of turns of the tubes in the layers without resorting to any distance pieces between the tube layers.

In this case the variable distances between the centers of the tube cross-sections are produced arbitrarily owing to the tube offsetting caused by close winding of the tubes 3 lengthwise and crosswise of the axis of the core 2. Owing to the afore-mentioned arrangement of the tubes 3 in the heat exchanger the latter resembles those with heat exchange surfaces having the so-called checkered and loose beds.

Similarly to these surfaces, the outline and size of the channels formed in the intertubular space of the proposed heat exchanger are varying continuously in a certain sequence which depends on the diameters of the tube 3, that of the wire and on the pitch it is wound with. In this case average geometric parameters of the channels are constant. Said inherent property of the proposed structure provides adequate conditions for stirring (turbulizing) a helium flow in the intertubular space of the heat exchanger ensuring high heat transfer coefficients. Moreover, it is of great importance for obtaining a small temperature difference in the heat exchanger. Said property of the proposed structure ensures also a uniform distribution of the helium flow over the heat exchanger cross-section. And, finally, a heat exchanger manufactured without any additional distance pieces rules out a possibility of heat transfer therealong and allows a continuous winding of the tubes 3 around the cylindrical core 2.

In one of the possible embodiments of the proposed heat exchanger each tube 3 can have on its external surface annular grooves 7 (FIGS. 4 through 6, 13) running along its entire length and projecting into said tube 3.

In this case either annular or helical grooves 7 can be employed. In case of helical grooves 7 the location of a helix may or may not coincide with that of the wire wound around the tube 3. The grooves 7 have a smooth contour, their height being small as compared with the diameter of the tube 3. Therefore the presence of said grooves 7 on the tube 3 does not interfere with the formation of fins thereon and does not disturb fin geometry.

Usually in high capacity helium refrigerators and liquefiers the thermodynamic cooling process is based on a low-pressure circuit (6–8 atm). In this case the heat transfer inside the tubes is not sufficiently intense. The grooves projecting into the tubes make it possible to intensify said heat transfer. The effect of said intensification of heat transfer is based on the near-the-wall fluid layer breaking away periodically from a smooth wall and on its artificial turbulizing. Owing to this phenomenon the heat transfer coefficient inside the tubes increases 2–3.5 times which is accompanied by a negligible increase in energy requirements for conveying the fluid along the tubes.

Figure 4:
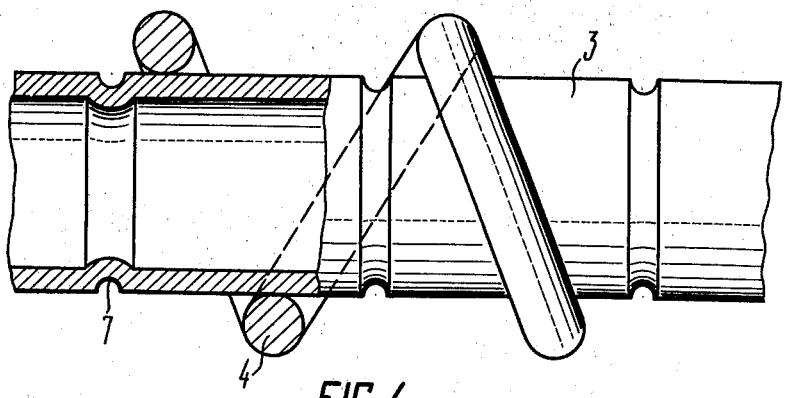
FIG. 4 is a fragnentary longitudinal sectional view of a heat exchanger tube having a wire wound thereabout and annular grooves.
Figure 5:
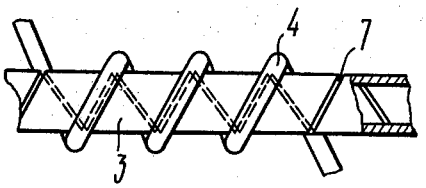
FIG. 5 shows a heat exchanger tube, finned with wire and having helical grooves whose location coincides with that of the wire.

In the herein-proposed heat exchanger the member 4 forming fins on the tube has a streamlined cross-section, as shown in FIG. 4.

A wire of a round, oval or shaped cross-section with streamlined fin tops or tubes of a similar cross-section can be used as the fin-making member 4.

With the above embodiment of the fin-making member it can be wound around the tube with tension, thus ensuring a reliable and intimate contact of the fin and the tube. In this case no soldering or welding are required for connecting the tube to the fin. The technology of production of finned tubes is substantially simplified. Moreover, the fins, according to the invention, can be produced from other metals differing from that of the tube, or from plastic materials.

With the above embodiment of the fins, the finned tubes can be wound tightly under tension without crumpling the fin. In this case the latter (the fin) can act simultaneously as a distance piece between the tube layers and coils.

The member 4 made from wire enables the use in a coiled heat exchanger of tubes 3 having small diameters and ensuring thereby a highly compact heat exchanger.

Thus, the proposed embodiments afford the possibility of creating an efficient, highly compact, simple to manufacture and long lasting coiled tubular heat exchanger.

The heat exchanger, according to the invention, functions in the following manner.

A fluid, such as a direct flow of hot gaseous helium is supplied from a compressor (not shown in the drawing) into a tubular header (not shown in the drawing) of the heat exchanger and is uniformly distributed in said header among the tubes 3 wound in several layers around the cylindrical core 2.

After that, some helium cooled in the tubes 3 passes into an expansion engine (not shown in the drawing) where it is cooled additionally on being expanded. The other part of the direct helium flow is throttled and a cold return flow of helium combines with the helium flow from the expansion engine and proceeds into the intertubular space of the heat exchanger where it gives its cold to the direct helium flow passing along the tubes 3.

For manufacturing said heat exchanger, according to the invention, described hereinafter are the proposed devices: the device for making fins on a tube, that for winding finned tubes around a core and the device for forming grooves on the external surface of a tube.

The device for making fins on a tube for the tubular coiled heat exchanger, according to the present invention, comprises a bed (not shown in the drawing) which mounts a hollow drive shaft 8 (FIG. 7).

Set up on said shaft 8 coaxially therewith is a sleeve 9 (FIGS. 7, 8) which is made composite and has a longitudinal junction plane. The sleeve 9 is rigidly fixed on the shaft 8 by a bolt 10 (FIG. 7). Said sleeve 9 has on its internal surface a thread 9*a* (FIG. 8) adapted for positive arrangement of the fin-making member 4 (FIG. 7), in this case of a wire, around the tube 3 and for axial feed of the tube 3 when the shaft 8 rotates together with the sleeve 9. The wire is wound on a drum 11 which is freely mounted on the hollow shaft 8.

Wire tension is provided by means of a spring 12 which is wound around the shaft 8 and clamped with the help of a nut 13 and a washer 14. A preset direction of motion of the wire 4 is ensured by rollers 15 arranged on a rest 16 fixed rigidly on the shaft 8. The drum 11 is fixed by means of a sleeve 17 arranged on the hollow shaft 8 and rigidly fixed thereto.

The device for making fins on a tube operates in the following manner. While said device is set for operation, the following operations are accomplished. The end of the tube 3 is unwound manually from a coil (not shown in the drawing) and the wire is wound thereabout (by making one of two turns) and tacked to the tube 3 (e.g., with soft solder). Next said tube end with several turns of the wire wound thereabout is arranged in the sleeve 9 which is then placed in the hollow shaft 8 and fixed therein by the bolt 10. Following that an electric motor (not shown in the drawing) is cut in and the finning operation is initiated. The motor imparts rotation to the hollow shaft 8 which in turn brings into rotation the sleeve 9 and drum 11. In this case the wire 4 is unwound from the drum 11 and wound around the tube 3.

Axial movement of the tube 3 is effected simultaneously with the winding of the wire 4, which is tensioned with the help of the spring 12 whose compression is adjusted with the nut 13.

The above embodiment of the device for making fins on a tube ensures adequate contact of the fin and the tube only under the effect of forces arising when the wire is being wound around the tube. In this case no soldering or welding is required to fasten the wire to the tube. Moreover, said embodiment makes it possible to provide a compact device in which the tube 3 unwound from the coil is simultaneously finned and advanced longitudinally. By changing the sleeves 9 one device can be utilized for making fins on tubes of various diameters and in various materials. In case the thread 9*a* wears down, the sleeves 9 are easily replaceable.

The device for winding finned tubes around the core 2 of the coiled tubular heat exchanger, according to the invention, comprises a bed 18 (FIG. 9), a motor with a reducer (not shown in the drawing), a guide means 19 for feeding the tubes 3 directly to the core 2, a gear 20 for feeding tubes 3 lengthwise of the axis of the core 2, a feed reel 21 (FIGS. 9, 10) for feeding the finned tube 3 to the rotating core 2, said feed reel 21 being set up on a support 22 in its top portion 23 (FIG. 10). The feed reel 21 with the supports 23 is mounted on a carriage 24 (FIG. 9) travelling along rails 25 axially with the core 2. The feed reel 21 is disposed on stationary bushes 26 and 27 (FIG. 10) (left-and right-hand ones) rotatably thereabout. The bushes 26 and 27 are arranged in the top portion 23 coupled to the support 22 by means of pins 28 which are freely introduced into special seats (not shown in the drawing). The bush 26 is rigidly fixed in the top portion 23 of the support 22 with the aid of a key 29, while the bush 27 is fixed by bolts 30 connecting a flange 27*a* of the bush 27 to the top portion 23 of said support 22. The bushes 26 and 27 are mounted coaxially with hubs 31 and 32 (left- and right-hand ones) of the reel 21. Accommodated freely in the bushes 26 and 27 is a shaft 33, said shaft having a possibility of rotating about its axis. The shaft 33 mounts a disc 34 rigidly fixed thereon and connected with the aid of springs 35 to the reel 21. The bushes 26 and 27 are tightly urged to the disc 34 with their and faces to preclude the pay-off of the tube 3 from the reel 21 when the core 2 is rotating. To adjust the forces urging the bushes 26 and 27 tightly to the disc 34 use is made of a spring 36 and a bolt 37, said spring 36 and bolt 37 being arranged in a sleeve 38 fastened to the top portion 23 of the support 22 by bolts 39. The springs 35 are wound around the hubs 31 and 32 so that one end of each spring is rigidly fixed to the periphery of the disc 34, the other end being fixed also rigidly on the reel 21. As a result, when the core 2 is in rotation the springs 35 are wound up and when it stops, they are unwound imparting a reverse rotation to the reel 21 to enable the tensioning of the tubes 3 in case of their sagging., e.g., when the core stops.

The device for winding finned tubes on the core of the coiled tubular heat exchanger operates in the following manner. The setting of said device for operation comprises the following steps. The reels 21 with the finned tubes 3 wound thereabout are mounted in the supports 22. The ends of the tubes 3 are uncoiled manually from the reel 21, passed through the guide means 19 and secured on the core 2. Next the motor is cut in, bringing the core 2 in rotation and carrying the guide means 19 along the core axis.

When the core 2 is rotating, the tubes 3 are wound thereabout, uncoiling under a tension from the feed reels 21. The latter (the reels 21) travel along the rails 25 axially with the core 2 in accordance with the longitudinal transfer of the guide means 19. At the first moment of rotation of said reels (after one or two revolutions) the springs 35 are wound up, the disc 34 being at this moment immovable. Upon winding up of the springs 35, the reel rotates together with said springs and with the disc 34. At the instant the core 2 stops, in case of sagging of the tubes, the springs 35 are unwound imparting the reels 21 a reverse rotation to enable the tensioning of said tubes 3. When the tubes 3 are wound around the core 2, tensioning is effected owing to friction forces arising between the disc 34 and the end faces of the bushes 26 and 27 when the reel 21 is rotating. In this case the force urging the bushes 26 and 27 tightly to the disc 34 is adjusted at the beginning of the winding operation with the help of a springs 36 and the bolt 37.

The above embodiment of the device for winding finned tubes around the core enhances its production rate and diminishes the labor input required for said operation; it also allows decreasing the number of operators which, as a rule, are busy with winding finned tubes manually around the core of a heat exchanger.

The device for forming grooves on the external surface of a tube, according to the invention, has a bed (not shown in the drawing), a drive hollow shaft 40 (FIG. 11) mounted on said bed and adapted to pass the tube 3 therethrough. The shaft 40 has a chuck 41 (FIGS. 11, 12), on which angles 42 are fixed by bolts 43. Arranged in said angles are pivots (FIGS. 11, 12, 13) of rollers 45 mounted rotatably about said pivots 44. The rollers 45 are provided with teeth 46 (FIG. 13) adapted for forming grooves on the tube 3 fed positively therebetween, e.g., with the aid of driven rollers (not shown in the drawing). The pivots 44 of the rollers 45 are fixed in oval notches 47 (FIG. 11) in the angles 42 by means of bolts 48 (FIG. 12) to enable the rollers 45 to rotate together with the shaft 40 and chuck 41. The rollers 45 together with the tube 3 are capable of moving within the oval notches 47 of the angles 42 with respect to the geometric axis of the shaft 40, the distance between the pivots 44 of the rollers 45 remaining constant. One pivot 44 of the roller 45 mounts pinions 49 (FIGS. 12, 13) rigidly fixed to the rollers 45 by dowels 50. The pinions 49 are adapted to keep the tops of the teeth 46 of the rollers 45 in a constant position, said tops facing each other when forming a groove.

The device for forming grooves on the external surface of the tube, according to the invention, operates in the following manner. The setting of said device for operation comprises the following steps. The tube 3 is unwound manually from a coil (not shown in the drawing), passed through the guide driven rollers (not shown in the drawing) and advanced to the rollers 45. Then a motor is cut in (not shown in the drawing) which brings into rotation the hollow shaft 40 together with the chuck 41, said shaft and the chuck imparting rotation to the rollers 45 and pinions 49, said rollers 45 and pinions 49 revolving around the tube 3. During the axial movement of the tube 3 which can be effected by resorting to one of the known methods, the rollers 45 rotate together with the pinions 49 about the pivot 44, their teeth 46 forming grooves on the tube 3.

The above embodiment of said device allows forming grooves on thin-walled tubes of a small diameter and of considerable length (in coils), as well as on tubes of various diameters and in various materials. The grooves formed by said device have the same depth irrespective of the tube offsetting which is frequently encountered in the tubes. The device can be utilized for forming grooves with various pitches and of various depths. The device for forming grooves, according to the present invention, can be mounted together with the device for making fins on a tube. This obviates the use of a gear for axial feed of a tube, insofar as the sleeve 9 ensures longitudinal transfer of the tube.

The proposed devices for making fins on a tube, for winding finned tubes around a cylindrical core and for forming grooves on the external surface of a tube, according to the invention, enable mechanization of the most labor-consuming steps in manufacturing coiled tubular heat exchangers. Therefore the production of the proposed heat exchanger becomes highly profitable it is simple technologically and requires small manual labour input.

The proposed coiled tubular heat exchanger has been tested under laboratory conditions. The results of said tests have demonstrated that the heat exchanger of the proposed design features high thermal properties and has relatively low pressure losses. It provides small temperature differences ($\Delta t$ below 0.2°). The compactness of the heat exchange surface made up by the tubes ranging in diameter from 0.3 mm to 8.0 mm amounts accordingly to 15,000–1,500 $m^2/m^3$ of a free volume.

The heat exchanger, according to the present invention, is technologically simple and the basic processes involved in its manufacture are mechanized. As shown by experiments, the heat exchangers of the proposed construction when utilized in helium refrigirators rated from 1 W to 500 W and producing cold down to 4.5 K. have displayed their high reliability.

What we claim is:

1. A generally compact multilayer tubular coiled heat exchanger comprising: a core; tubes having essentially the same length and tightly wound around said core in at least two layers; streamlined finned members in the form of wire rods being wound around each of said tubes with a pitch of at least twice the thickness of said member; a shell mounted coaxially with said core and encompassing it; said tubes are adapted to pass a fluid therealong and therebetween in a space defined by said shell and said core, said tubes being wound around said core to form coils, so that the distances between the centers of the cross-section of tube coils in one layer and between the centers of the cross-sections of the same tube coils of said layer gradually vary from a value equal to the sum of the diameter of one of said tubes plus twice the height of a wire rod fin to a value equal to the sum of the diameter of said tube plus a single height of the wire rod fin, the above distance relationship periodically repeating over the entire length and cross-section of the heat exchanger; wherein the finned wire rod surfaces of each tube coil alternately contacts the finned wire rod surfaces and the tube surface of the adjacent tube coils and wherein the number of turns in the layers of a multilayer tubular coiled heat exchanger can be varied without the need for structure distant pieces between the tube layers.

2. A heat exchanger of claim 1, in which each of said tubes has on its external surface annular grooves running along the entire length of said tube and projecting into said tube.

3. A heat exchanger of claim 1, in which said member for making fins on each of said tubes has a streamlined cross-section.

* * * * *